US011800891B2

(12) United States Patent
Mohseni

(10) Patent No.: US 11,800,891 B2
(45) Date of Patent: Oct. 31, 2023

(54) AEROSOL-GENERATING ARTICLE WITH IMPROVED OUTERMOST WRAPPER

(71) Applicant: Philip Morris Products S.A., Neuchatel (CH)

(72) Inventor: Farhang Mohseni, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 178 days.

(21) Appl. No.: 17/355,753

(22) Filed: Jun. 23, 2021

(65) Prior Publication Data

US 2021/0315263 A1 Oct. 14, 2021

Related U.S. Application Data

(63) Continuation of application No. 16/339,250, filed as application No. PCT/EP2018/073538 on Aug. 31, 2018, now Pat. No. 11,076,633.

(30) Foreign Application Priority Data

Sep. 7, 2017 (EP) ..... 17190002

(51) Int. Cl.
*A24D 1/02* (2006.01)
*A24D 1/22* (2020.01)

(52) U.S. Cl.
CPC ..... *A24D 1/02* (2013.01); *A24D 1/22* (2020.01)

(58) Field of Classification Search
USPC ..... 131/347, 360, 365
See application file for complete search history.

(56) References Cited

U.S. PATENT DOCUMENTS 3,106,210 A 10/1963 Reynolds
5,040,551 A 8/1991 Schlatter et al.
(Continued)

FOREIGN PATENT DOCUMENTS

CN 1290131 A 4/2001
CN 204796727 U 11/2015
(Continued)

OTHER PUBLICATIONS

Emissivity-Metals, Fluke, [online], retrieved from the Internet, [retrieved Feb. 22, 2023],<URL:https://www.flukeprocessinstruments.com/en-us/service-and-support/knowledge-center/infrared-technology/emissivitymetals#:~:text=Emissivity%20Values%20for%20Metals%20%20%20%20%20Material,%20%200.2- (Year: 2023).*
(Continued)

*Primary Examiner* — Dennis R Cordray
(74) *Attorney, Agent, or Firm* — Oblon, McClelland, Maier & Neustadt, L.L.P.

(57) ABSTRACT

An aerosol-generating article is provided, including: an aerosol-forming substrate configured to be heated to generate an aerosol, the aerosol-generating article not including an aerosol-forming substrate that is configured to be combusted to produce smoke; and an outermost wrapper around at least a portion of the aerosol-forming substrate, an outer surface of the outermost wrapper forming at least part of an outer surface of the aerosol-generating article, the outermost wrapper including a metallized substrate including a substrate layer and a metal layer radially outward of the substrate layer, and the substrate layer being coated with the metal layer by vapour deposition.

17 Claims, 1 Drawing Sheet

(56) References Cited

U.S. PATENT DOCUMENTS

| | | | | |
|---|---|---|---|---|
| 6,367,481 | B1 | 4/2002 | Nichols et al. | |
| 11,076,633 | B2 * | 8/2021 | Mohseni | A24D 1/22 |
| 2002/0174875 | A1 | 11/2002 | Nichols et al. | |
| 2005/0000533 | A1 | 1/2005 | Yamada | |
| 2012/0067360 | A1 | 3/2012 | Conner et al. | |
| 2013/0306085 | A1 | 11/2013 | Sanchez et al. | |
| 2015/0201670 | A1 | 7/2015 | Crooks | |
| 2016/0331031 | A1 | 11/2016 | Malgat et al. | |
| 2020/0268039 | A1 * | 8/2020 | Lavanchy | A24D 1/002 |

FOREIGN PATENT DOCUMENTS

| | | | |
|---|---|---|---|
| CN | 107105760 | A | 8/2017 |
| EP | 0 472 367 | B1 | 2/1992 |
| EP | 0 822 760 | A0 | 2/1998 |
| JP | 58-139089 | U | 9/1983 |
| JP | 2002-500032 | A | 1/2002 |
| JP | 2010-253412 | A | 11/2010 |
| JP | 2019-531086 | A | 10/2019 |
| KR | 10 2015 0009544 | A | 1/2015 |
| KR | 10 2015 0093182 | A | 8/2015 |
| KR | 10-2016-0042417 | A | 4/2016 |
| KR | 10 2016 0052534 | A | 5/2016 |
| KZ | 32289 | B | 8/2017 |
| RU | 2 195 849 | C2 | 6/2001 |
| RU | 2 305 480 | C2 | 9/2007 |
| RU | 2 503 383 | C2 | 1/2014 |
| RU | 2 524 887 | C2 | 8/2014 |
| WO | 96/32854 | A2 | 10/1996 |
| WO | 2009/022232 | A2 | 2/2009 |
| WO | 2009/074870 | A2 | 6/2009 |
| WO | 2011/045066 | A1 | 4/2011 |
| WO | 2012/164077 | A1 | 12/2012 |
| WO | 2013/173440 | A1 | 11/2013 |
| WO | 2015/022320 | A2 | 2/2015 |
| WO | 2017/114744 | A1 | 7/2017 |
| WO | 2017/114760 | A1 | 7/2017 |
| WO | 2017/114895 | A1 | 7/2017 |
| WO | 2017/115196 | A1 | 7/2017 |

OTHER PUBLICATIONS

Continuation of U: 0.4%20%2063%20more%20rows%20>. (Year: 2023).*

U.S. Appl. No. 16/339,250, filed Apr. 3, 2019, 2020/0221760 A1, Farhang Mohseni.

International Search Report dated Nov. 22, 2018 in PCT/EP2018/073538 filed Aug. 31, 2018.

Combined Office Action and Search Report dated Jul. 30, 2019 in Russian Patent Application No. 2019112735, citing documents BF and BG therein, 17 pages (with English translation).

Korean Office Action dated Sep. 2, 2019, in Patent Application No. 10-2019-7011632, citing document BH therein, 10 pages (with English translation).

Japanese Office Action dated Oct. 21, 2019 in Japanese Patent Application No. 2019-525962 (with English translation), citing documents BI and BJ therein, 7 pages.

Korean Office Action dated Feb. 27, 2020 in Patent Application No. 10-2019-7011632 (with English translation), citing documents BK-BM therein, 3 pages.

Combined Chinese Office Action and Search Report dated Apr. 14, 2020 in Chinese Patent Application No. 201880007989.5 (with English translation), citing documents BN-BQ therein, 12 pages.

Notice of Grounds for Rejection dated Sep. 20, 2022 in Japanese Patent Application No. 2020-072793 (with English language translation), citing documents 15 and 16 therein, 11 pages.

Russian Office Action and Search Report dated May 31, 2023 in Russian Patent Application No. 2020112803 filed on May 31, 2018, with English translation, total 17 pages.

* cited by examiner

AEROSOL-GENERATING ARTICLE WITH IMPROVED OUTERMOST WRAPPER

CROSS-REFERENCE TO RELATED APPLICATIONS

This application is a continuation application of and claims the benefit of priority under 35 U.S.C. § 120 to U.S. application Ser. No. 16/339,250, filed Apr. 3, 2019, which is a National Stage Application of PCT/EP2018/073538, filed Aug. 31, 2018, and claims benefit of priority under 35 U.S.C. § 119 to European Patent Application No. 17190002.0, filed on Sep. 7, 2017, the entire contents of each of which are incorporated herein by reference.

TECHNICAL FIELD

The present invention relates to a heated aerosol-generating article comprising an aerosol-forming substrate.

DESCRIPTION OF THE RELATED ART

A number of aerosol-generating articles in which tobacco material is heated rather than combusted have been proposed in the art. An aim of such 'heated' smoking articles is to reduce known harmful smoke constituents of the type produced by the combustion and pyrolytic degradation of tobacco in conventional cigarettes.

Typically in heated aerosol-generating articles, an aerosol is generated by the transfer of heat from a heat source, for example, a chemical, electrical or combustible heat source, to a physically separate aerosol-forming substrate, which may be located within, around or downstream of the heat source.

In one type of heated aerosol-generating article, an aerosol is generated by the transfer of heat from a combustible carbonaceous heat source to a physically separate aerosol-forming substrate comprising tobacco material that is located downstream of the combustible carbonaceous heat source. In use, volatile compounds are released from the tobacco material by heat transfer to the aerosol-forming substrate from the combustible carbonaceous heat source and entrained in air drawn through the smoking article. As the released compounds cool, they condense to form an aerosol that is inhaled by the user.

In such heated aerosol-generating articles it is known to include one or more heat-conducting elements around at least a portion of the aerosol-forming substrate of the heated smoking article in order to provide conductive heat transfer from the combustible carbonaceous heat source to the aerosol-forming substrate to generate an aerosol. In particular, it is known to include a heat-conducting element around at least a rear portion of the combustible carbonaceous heat source and at least a front portion of the aerosol-forming substrate of the heated smoking article in order to provide conductive heat transfer from the combustible carbonaceous heat source to the aerosol-forming substrate to generate an aerosol. For example, WO 2009/022232 A2 discloses a smoking article comprising a combustible carbonaceous heat source, an aerosol-forming substrate downstream of the combustible heat source, and a heat-conducting element around and in direct contact with a rear portion of the combustible carbonaceous heat source and an adjacent front portion of the aerosol-forming substrate. In use, heat generated during combustion of the combustible carbonaceous heat source is transferred to the periphery of the front portion of the aerosol-forming substrate by conduction through the abutting downstream end of the combustible carbonaceous heat source and the heat-conducting element.

In another type of heated aerosol-generating article, an aerosol is generated by the transfer of heat from an electric heater to an aerosol-forming substrate comprising tobacco material. The aerosol-generating article comprising the aerosol-forming substrate is typically inserted into a chamber or cavity in a physically separate aerosol-generating device comprising the electric heater. For example, EP 0 822 760 A2 discloses an electrical smoking system comprising a lighter and an article comprising a tobacco rod, said tobacco rod comprising a tubular tobacco web and a plug of tobacco disposed within said tubular tobacco web. The lighter has a plurality of resistive heater blades defining a receptacle for receiving the article, whereby the blades at least partially overlap said tobacco plug when said article is inserted into the receptacle.

In a further type of heated aerosol-generating article, an aerosol is generated by the transfer of heat from a susceptor to an aerosol-forming substrate comprising tobacco material. In use, eddy currents are induced in the susceptor by an alternating electromagnetic field produced by an induction source in a physically separate inductive heating device. Heat is generated in the susceptor due to resistive losses (Joule heating). Heat may also be generated in the susceptor due to hysteresis losses where the susceptor is magnetic. Volatile compounds are released from the tobacco material by heat transfer to the aerosol-forming substrate from the susceptor and entrained in air drawn through the smoking article. As the released compounds cool, they condense to form an aerosol that is inhaled by the user.

In heated aerosol-generating articles in which an aerosol-forming substrate is heated rather than combusted, the temperature attained in the aerosol-forming substrate has a significant impact on the ability to generate a sensorially acceptable aerosol. It is typically desirable to maintain the temperature of the aerosol-forming substrate within a certain range in order to optimise the aerosol delivery to the user. In some cases, radiative heat losses from the outer surface of the aerosol-generating article may cause the temperature of the aerosol-forming substrate to drop outside of the desired range, thereby impacting the performance of the aerosol-generating article. If the temperature of the aerosol-forming substrate drops too low, for instance, it may adversely impact the consistency and the amount of aerosol delivered to the user.

It would be desirable to provide a heated aerosol-generating article in which there is improved management of the temperature profile of the heated aerosol-generating article during use in order to help maintain the temperature of the aerosol-forming substrate within a desired temperature range.

In particular, it would be desirable to provide a heated aerosol-generating article comprising a combustible heat source and an aerosol-forming substrate in which there is improved control of the conductive heating of the aerosol-forming substrate during use in order to help maintain the temperature of the aerosol-forming substrate within a desired temperature range.

SUMMARY

According to the invention there is provided an aerosol-generating article comprising: an aerosol-forming substrate; and an outermost wrapper around at least a portion of the aerosol-forming substrate, wherein an outer surface of the outermost wrapper forms at least part of an outer surface of the aerosol-generating article and wherein the outermost wrapper comprises a metallised substrate comprising a substrate layer and a metal layer radially outward of the substrate layer, the metal layer having a thickness of less than or equal to about 100 nanometres.

BRIEF DESCRIPTION OF THE DRAWINGS

The invention will be further described, by way of example only, with reference to the accompanying drawings in which.

DETAILED DESCRIPTION

Figure 1:
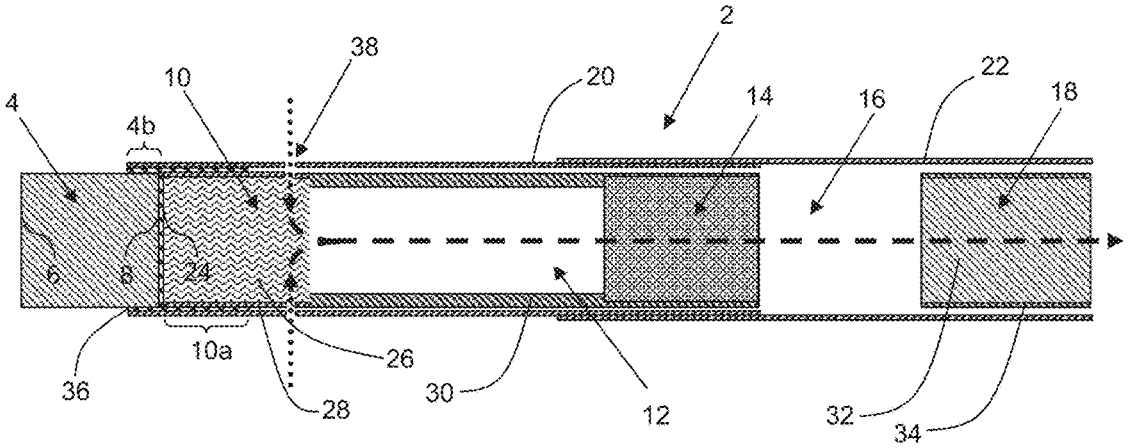
FIG. 1 shows a schematic longitudinal cross-section of an aerosol-generating article according to an embodiment of the invention.

As used herein with reference to the invention, the terms 'distal', 'upstream' and 'front', and 'proximal', 'downstream' and 'rear', are used to describe the relative positions of components, or portions of components, of the aerosol-generating article. The aerosol-generating article comprises a proximal end through which, in use, an aerosol exits the aerosol-generating article for delivery to a user. The proximal end of the aerosol-generating article may also be referred to as the mouth end. In use, a user draws on the proximal end of the aerosol-generating article in order to inhale an aerosol generated by the aerosol-generating article.

The aerosol-generating article comprises a distal end. The proximal end of the aerosol-generating article is downstream of the distal end of the aerosol-generating article. The proximal end of the aerosol-generating article may also be referred to as the downstream end of the aerosol-generating article and the distal end of the aerosol-generating article may also be referred to as upstream end of the aerosol-generating article. Components, or portions of components, of the aerosol-generating article may be described as being upstream or downstream of one another based on their relative positions between the proximal end of the aerosol-generating article and the distal end of the aerosol-generating article.

As used herein with reference to the invention, the terms 'longitudinal' and 'axial' are used to describe the direction between the proximal end and the distal end of the aerosol-generating article.

As used herein with reference to the invention, the term 'length' is used to describe the maximum dimension of components, or portions of components, of the aerosol-generating article in the longitudinal direction of the aerosol-generating article. That is, the maximum dimension in the direction between the proximal end and the distal end of the aerosol-generating article.

As used herein with reference to the invention, the terms 'transverse' and 'radial' used to describe the direction perpendicular to the longitudinal direction. That is, the direction perpendicular to the direction between the proximal end and the distal end of the aerosol-generating article.

As used herein with reference to the invention, the term 'diameter' denotes the maximum dimension in the transverse direction of the aerosol-generating article.

As used herein with reference to the invention, the term 'aerosol-forming substrate' is used to describe a substrate comprising aerosol-forming material capable of releasing upon heating volatile compounds, which can form an aerosol. The aerosols generated from aerosol-forming substrates of aerosol-generating articles according to the invention may be visible or invisible and may include vapours (for example, fine particles of substances, which are in a gaseous state, that are ordinarily liquid or solid at room temperature) as well as gases and liquid droplets of condensed vapours.

As used herein with reference to the invention, the term 'outermost wrapper' is used to describe a radially outermost wrapper around at least a portion of the aerosol-forming substrate of the aerosol-generating article.

Aerosol-generating articles according to the invention do not comprise any additional wrappers around the aerosol-forming substrate that are radially outward of all of the outermost wrapper around the aerosol-forming substrate. That is, aerosol-generating articles according to the invention do not comprise any additional wrappers around the aerosol-forming substrate that overlie all of the outermost wrapper around the aerosol-forming substrate.

Aerosol-generating articles according to the invention may further comprise one or more additional wrappers around the aerosol-forming substrate that are radially outward of a portion of the outermost wrapper around the aerosol-forming substrate. That is, aerosol-generating articles according to the invention may comprise one or more additional wrappers around the aerosol-forming substrate that overlie a portion of the outermost wrapper around the aerosol-forming substrate.

Advantageously, aerosol-generating articles according to the invention do not comprise any additional wrappers around the aerosol-forming substrate that are radially outward of the outermost wrapper. That is, advantageously aerosol-generating articles according to the invention do not comprise any additional wrappers around the aerosol-forming substrate that overlie the outermost wrapper.

As used herein with reference to the invention, the term 'outer surface' is used to describe a radially outermost surface of the aerosol-generating article or a radially outermost surface of a components, or portion of a component, of the aerosol-generating article.

The outermost wrapper may be around one or more additional components of the aerosol-generating article. In such embodiments, the aerosol-generating article may comprise one or more additional wrappers around the one or more additional components of the aerosol-generating article that are radially outward of the outermost wrapper.

The aerosol-generating article may comprise one or more additional wrappers radially inward of the outermost wrapper. That is, the aerosol-generating article may comprise one or more additional wrappers underlying the outermost wrapper.

The outermost wrapper is around at least a portion of the aerosol-forming substrate. That is, the outermost wrapper overlies at least a portion of the aerosol-forming substrate.

Advantageously, the outermost wrapper is around the entire length of the aerosol-forming substrate. That is, the outermost wrapper overlies the entire length of the aerosol-forming substrate.

Paper wrappers typically have high emissivity. In heated aerosol-generating articles comprising an outermost paper wrapper around the aerosol-forming substrate, high emissivity of the paper wrapper may disadvantageously result in radiative heat losses from the aerosol-generating article. As described above, such heat losses may disadvantageously cause the temperature of the aerosol-forming substrate to drop outside of the desired range, thereby negatively impacting the performance of the aerosol-generating article.

Metal wrappers typically have low emissivity. However, metal wrappers typically also have high thermal diffusivity. In heated aerosol-generating articles comprising an outermost metal wrapper around the aerosol-forming substrate, high thermal diffusivity of the metal wrapper may disadvantageously result in conductive heat losses to other components of the aerosol-generating article. Such heat losses may also disadvantageously cause the temperature of the aerosol-forming substrate to drop outside of the desired range, thereby negatively impacting the performance of the aerosol-generating article.

It has been found that by providing an outermost wrapper around at least a portion of the aerosol-substrate wherein the outermost wrapper comprises a metallised substrate comprising a substrate layer and a metal layer radially outward of the substrate layer, the metal layer having a thickness of less than or equal to about 100 nanometres, both radiative and conductive heat losses may advantageously be reduced.

Provision of such an outermost wrapper around at least a portion of the aerosol-substrate advantageously helps to better maintain the temperature of the aerosol-substrate within a desired temperature range. This in turn advantageously improves generation of aerosol from the aerosol-forming substrate.

Provision of such an outermost wrapper advantageously helps to more effectively use heat transferred from a heat source to heat the aerosol-forming substrate to a desired temperature. Provision of such an outermost wrapper also advantageously helps maintain the temperature of the aerosol-forming substrate at a higher level. Provision of such an outermost wrapper may significantly increase the overall delivery of aerosol to the user.

As used herein with reference to the invention, the term 'metallised substrate' is used to describe a substrate coated with a layer of metal by vapour deposition.

Advantageously, the metal layer of the metallised substrate is formed by physical vapour deposition.

The metal layer of the metallised substrate has a thickness of less than or equal to about 100 nanometres.

Without wishing to be bound by theory, it is believed that the metal layer of the metallised substrate has a low thermal diffusivity compared to other metal wrappers.

This advantageously results in less heat being conducted through the outermost wrapper of aerosol-generating articles according to the invention than aerosol-generating articles comprising an outermost metal wrapper around the aerosol-forming substrate having a thickness of, for example, 500 nanometres or more, which have a significantly higher thermal diffusivity.

The metal layer of the metallised substrate advantageously has a thickness of less than or equal to about 100 nanometres as measured by scanning electron microscopy (SEM).

The metal layer of the metallised substrate may advantageously have a thickness of less than or equal to about 80 nanometres, less than or equal to about 60 nanometres, less than or equal to about 40 nanometres or less than or equal to about 25 nanometres.

The metal layer of the metallised substrate may advantageously have a thickness of, greater than or equal to about 2 nanometres, greater than or equal to about 5 nanometres, greater than or equal to about 10 nanometres or greater than or equal to about 15 nanometres.

The metal layer of the metallised substrate may have a thickness of between about 2 nanometres and about 100 nanometres, between about 2 nanometres and about 80 nanometres, between about 2 nanometres and about 60 nanometres, between about 2 nanometres and about 40 nanometres or between about 2 nanometres and about 25 nanometres.

The metal layer of the metallised substrate may have a thickness of between about 5 nanometres and about 100 nanometres, between about 5 nanometres and about 80 nanometres, between about 5 nanometres and about 60 nanometres, between about 5 nanometres and about 40 nanometres or between about 5 nanometres and about 25 nanometres.

The metal layer of the metallised substrate may have a thickness of between about 10 nanometres and about 100 nanometres, between about 10 nanometres and about 80 nanometres, between about 10 nanometres and about 60 nanometres, between about 10 nanometres and about 40 nanometres or between about 5 nanometres and about 25 nanometres.

The metal layer of the metallised substrate may have a thickness of between about 15 nanometres and about 100 nanometres, between about 15 nanometres and about 80 nanometres, between about 15 nanometres and about 60 nanometres, between about 15 nanometres and about 40 nanometres or between about 5 nanometres and about 25 nanometres.

The weight of the metal layer may be between about 0.02 grams per square metre and about 1 gram per square metre.

The metal layer of the metallised substrate may be formed from any suitable metal. For example, the metallised layer may be formed from aluminium, chromium, copper, gold, nickel, silver or tin.

Advantageously, the metal layer of the metallised substrate is an aluminium layer.

The metal layer of the metallised substrate is radially outward of the substrate layer of the metallised substrate.

The substrate layer of the metallised substrate is a non-metallic layer. That is, the substrate layer of the metallised substrate is not a metal layer or an alloy layer.

The substrate layer of the metallised substrate may advantageously have a thickness of less than or equal to about 120 micrometres, less than or equal to about 100 micrometres or less than or equal to about 80 micrometres.

The substrate layer of the metallised substrate may advantageously have a thickness of greater than or equal to about 10 micrometres, greater than or equal to about 20 micrometres or greater than or equal to about 40 micrometres.

The substrate layer of the metallised substrate may have a thickness of between about 10 micrometres and about 120 micrometres, between about 10 micrometres and about 100 micrometres or between about 10 micrometres and about 80 micrometres.

The substrate layer of the metallised substrate may have a thickness of between about 20 micrometres and about 120 micrometres, between about 20 micrometres and about 100 micrometres or between about 20 micrometres and about 80 micrometres.

The substrate layer of the metallised substrate may have a thickness of between about 40 micrometres and about 120 micrometres, between about 40 micrometres and about 100 micrometres or between about 40 micrometres and about 80 micrometres.

The substrate layer of the metallised substrate may be formed from any suitable substrate material. For example, the substrate layer may be formed from paper or polymeric material.

Advantageously, the substrate layer of the metallised substrate is a paper layer.

As used herein with reference to the invention, the term "paper layer" is used to describe a layer formed from cellulosic fibres.

The paper layer may have a basis weight of between about 25 grams per square metre and about 120 grams per square metre or between about 35 grams per square metre and about 60 grams per square metre.

Advantageously, the outer surface of the outermost wrapper has an emissivity of less than or equal to about 0.6 at 23° C. and a relative humidity of 50% as measured in accordance with the test procedure set out in ISO 18434-1.

The test method uses a reference material of known emissivity to determine the unknown emissivity of a sample material. Specifically, the reference material is applied over a portion of the sample material and both materials are heated to a temperature of 100° C. The surface temperature of the reference material is then measured using an infrared camera and the camera system is calibrated using the known emissivity of the reference material. A suitable reference material is black polyvinyl chloride electrical insulation tape, such as Scotch® 33 Black Electrical Tape, which has an emissivity value of 0.95. Once the system has been calibrated using the reference material the infrared camera is repositioned to measure the surface temperature of the sample material. The emissivity value on the system is adjusted until the measured surface temperature of the sample material matches the actual surface temperature of the sample material, which is the same as the surface temperature of the reference material. The emissivity value at which the measured surface temperature matches the actual surface temperature is the true emissivity value for the sample material.

Emissivity is a measure of the effectiveness of a surface in emitting energy as thermal radiation.

Inclusion of an outermost wrapper with an outer surface having an emissivity of less than about 0.6 may advantageously reduce radiative heat losses from the aerosol-generating article via the outermost wrapper.

Advantageously, the outer surface of the outermost wrapper has an emissivity less than or equal to about 0.5 or less than or equal to about 0.4.

Advantageously, the outer surface of the outermost wrapper has an emissivity of greater than or equal to about 0.1 or greater than or equal to about 0.2.

The outer surface of the outermost wrapper may have an emissivity of between about 0.1 and about 0.6, between about 0.1 and about 0.5 or between about 0.1 and about 0.4.

The outer surface of the outermost wrapper may have an emissivity of between about 0.2 and about 0.6, between about 0.2 and about 0.5 or between about 0.2 and about 0.4.

An outer surface of the metal layer of the metallised substrate may form at least part of an outer surface of the outermost wrapper.

The metal layer of the metallised substrate has an inner surface and an outer surface.

The inner surface of the metal layer of the metallised substrate faces towards the substrate layer of the metallised substrate.

The outer surface of the metal layer of the metallised substrate faces away the substrate layer of the metallised substrate.

An outer surface of the metal layer of the metallised substrate of the outermost wrapper may form at least part of an outer surface of the aerosol-generating article. In such embodiments, the outer surface of the metal layer of the metallised substrate is visible on the exterior of the aerosol-generating article.

The outermost wrapper may further comprise a surface coating on at least a portion of an outer surface of the metal layer of the metallised substrate.

Provision of a surface coating on at least a portion of an outer surface of the metal layer of the metallised substrate may advantageously allow further management of the thermal properties of the aerosol-generating article.

The surface coating may form at least part of an outer surface of the outermost wrapper.

The surface coating may advantageously be selected to provide the outer surface of the outermost wrapper with a desired emissivity.

The surface coating may form at least part of an outer surface of the aerosol-generating article. In such embodiments, the surface coating is visible on the exterior of the aerosol-generating article.

The surface coating may advantageously be selected to provide the exterior of the aerosol-generating article with a desired appearance.

The surface coating may be formed from one or more suitable materials.

Advantageously, the surface coating comprises one or more inorganic materials.

More advantageously, the surface coating comprises one or more inorganic materials that are heat stable to at least about 300° C. or at least about 400° C.

In certain embodiments, the surface coating comprises one or more inorganic materials selected from the group consisting of graphite, metal oxides and metal carbonates.

For example the surface coating may comprise one or more metal oxides selected from titanium dioxide, aluminium oxide, and iron oxide.

In certain preferred embodiments, the surface coating comprises calcium carbonate.

The surface coating may be provided on one or more portions of the outer surface of the metal layer of the metallised substrate.

The surface coating may be provided on substantially the entire outer surface of the metal layer of the metallised substrate.

The surface coating may be a substantially continuous coating.

The surface coating may be a discontinuous coating.

The surface coating may be applied to the outer surface of the metal layer of the metallised substrate after assembly of the aerosol-generating article.

Advantageously, the surface coating is applied to the outer surface of the metal layer of the metallised substrate container prior to assembly of the aerosol-generating article.

The surface coating may be applied to the outer surface of the metal layer of the metallised substrate by any suitable method. For example, the surface coating may be applied to the metal layer of the metallised substrate by brushing, spraying, rolling or printing a surface coating composition onto the outer surface of the metal layer of the metallised substrate.

For example, a surface coating may be applied to the outer surface of the metal layer of the metallised substrate by gravure or rotogravure printing, flexographic printing, lithographic printing, offset printing or screen printing a surface coating composition onto the outer surface of the metal layer of the metallised substrate.

The surface coating composition may comprise a binder.

The surface coating composition may comprise a cellulosic binder or a non-cellulosic binder. For example, the surface coating may comprise one or more cellulosic binders selected from the group consisting of ethyl cellulose, carboxy methyl cellulose and hydroxyl ethyl cellulose.

The surface coating composition may comprise a solvent.

The surface coating composition may comprise an aqueous solvent or a non-aqueous solvent. For example, the surface coating composition may comprise water or isopropanol.

The weight of the surface coating on the outer surface of the metal layer of the metallised substrate may, for example, be between about 0.5 grams per square metre and about 5 grams per square metre.

The thickness of the surface coating on the outer surface of the metal layer of the metallised substrate may, for example, be between about 0.5 micrometres and about 2 micrometres.

The composition, amount and thickness of the surface coating on the outer surface of the metal layer of the metallised substrate may be selected to achieve a desired emissivity.

Advantageously, the aerosol-forming substrate comprises aerosol-forming material comprising an aerosol-former.

The aerosol former may be any suitable compound or mixture of compounds that, in use, facilitates formation of a dense and stable aerosol and that is substantially resistant to thermal degradation at the operating temperature of the aerosol-generating article. Suitable aerosol formers are known in the art and include, but are not limited to: polyhydric alcohols, such as triethylene glycol, propylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Advantageously, the aerosol former comprises one or more polyhydric alcohols.

More advantageously, the aerosol former comprises glycerine.

Preferably, the aerosol-forming substrate is a solid aerosol-forming substrate. The aerosol-forming substrate may comprise both solid and liquid components.

The aerosol-forming substrate may comprise plant-based material. The aerosol-forming substrate may comprise homogenised plant-based material.

The aerosol-forming substrate may comprise nicotine.

The aerosol-forming substrate may comprise tobacco material.

As used herein with reference to the invention, the term 'tobacco material' is used to describe any material comprising tobacco, including, but not limited to, tobacco leaf, tobacco rib, tobacco stem, tobacco stalk, tobacco dust, expanded tobacco, reconstituted tobacco material and homogenised tobacco material.

The tobacco material may, for example, be in the form of powder, granules, pellets, shreds, strands, strips, sheets or any combination thereof.

Advantageously, the aerosol-forming substrate comprises homogenised tobacco material.

As used herein with reference to the invention, the term 'homogenised tobacco material' is used to describe a material formed by agglomerating particulate tobacco.

Advantageously, the aerosol-forming substrate comprises a gathered sheet of homogenised tobacco material.

In certain embodiments, the aerosol-forming substrate comprises a rod comprising a gathered sheet of homogenised tobacco material.

The aerosol-forming substrate may comprise aerosol-forming material and a wrapper around and in contact with the aerosol-forming material.

The wrapper may be formed from any suitable sheet material that is capable of being wrapped around aerosol-forming material to form an aerosol-forming substrate.

In certain preferred embodiments, the aerosol-forming substrate comprises a rod comprising a gathered sheet of homogenised tobacco material and a wrapper around and in contact with the tobacco material.

As used herein with reference to the invention, the term 'rod' is used to denote a generally cylindrical element of substantially circular, oval or elliptical cross-section.

As used herein with reference to the invention, the term 'sheet' is used to describe a laminar element having a width and length substantially greater than the thickness thereof.

As used herein with reference to the invention, the term 'gathered' is used to describe a sheet that is convoluted, folded, or otherwise compressed or constricted substantially transversely to the longitudinal axis of the aerosol-generating article.

Advantageously, the aerosol-forming substrate comprises a gathered textured sheet of homogenised tobacco material.

As used herein with reference to the invention, the term 'textured sheet' is used to describe a sheet that has been crimped, embossed, debossed, perforated or otherwise deformed.

Use of a textured sheet of homogenised tobacco material may advantageously facilitate gathering of the sheet of homogenised tobacco material to form the aerosol-forming substrate.

The aerosol-forming substrate may comprise a gathered textured sheet of homogenised tobacco material comprising a plurality of spaced-apart indentations, protrusions, perforations or any combination thereof.

In certain preferred embodiments, the aerosol-forming substrate comprises a gathered crimped sheet of homogenised tobacco material.

As used herein with reference to the invention, the term 'crimped sheet' is used to describe a sheet having a plurality of substantially parallel ridges or corrugations.

Advantageously, when the aerosol-generating article has been assembled, the substantially parallel ridges or corrugations extend along or parallel to the longitudinal axis of the aerosol-generating article. This facilitates gathering of the crimped sheet of homogenised tobacco material to form the aerosol-forming substrate.

However, it will be appreciated that crimped sheets of homogenised tobacco material for inclusion in the aerosol-forming substrates of aerosol-generating articles according to the invention may alternatively or in addition have a plurality of substantially parallel ridges or corrugations that are disposed at an acute or obtuse angle to the longitudinal axis of the aerosol-generating article when the aerosol-generating article has been assembled.

Preferably, the aerosol-forming substrate is substantially cylindrical.

The aerosol-forming substrate may have a length of between about 5 millimetres and about 20 millimetres, for example a length of between about 6 millimetres and about 15 millimetres or a length of between about 7 millimetres and about 12 millimetres.

The aerosol-forming substrate may have a diameter of between about 5 millimetres and about 9 millimetres, for example a diameter of between about 7 millimetres and about 8 millimetres.

Advantageously, the aerosol-generating article further comprise a heat-conducting element radially inward of the outermost wrapper.

Advantageously, the heat-conducting element is around at least a portion of the aerosol-forming substrate. In such embodiments, the heat-conducting element transfers heat to the periphery of the aerosol-forming substrate by conduction.

More advantageously, the heat-conducting element is around and in contact with at least a portion of the aerosol-forming substrate. This may advantageously facilitate conductive heat transfer to the periphery of the aerosol-forming substrate.

The heat-conducting element may be around the entire length of the aerosol-forming substrate. That is, the heat-conducting element may overlie the entire length of the aerosol-forming substrate.

Advantageously, the heat-conducting element is not around a rear portion of the aerosol-forming substrate. That is, the aerosol-forming substrate advantageously extends longitudinally beyond the heat-conducting element in a downstream direction.

Advantageously, the aerosol-forming substrate extends longitudinally at least about 3 millimetres beyond the heat-conducting element in a downstream direction.

Advantageously, the heat-conducting element is non-combustible.

The heat conducting element may be oxygen restricting. In other words, the heat-conducting element may inhibit or resist the passage of oxygen through the heat-conducting element.

The heat-conducting element may be formed from any suitable thermally conductive material or combination of materials.

Preferably, the heat-conducting element comprises one or more heat-conductive materials having a bulk thermal conductivity of between about 10 W per metre Kelvin (W/(m·K)) and about 500 W per metre Kelvin (W/(m·K)), more preferably between about 15 W per metre Kelvin (W/(m·K)) and about 400 W per metre Kelvin (W/(m·K)), at 23° C. and a relative humidity of 50% as measured using the modified transient plane source (MTPS) method.

Advantageously, the heat-conducting elements comprises one or more metals, one or more alloys or a combination of one or more metals and one or more alloys.

Suitable thermally conductive materials are known in the art and include, but are not limited to: metal foils, such as, for example, aluminium foil, iron foil and copper foil; and alloy foils, such as, for example, steel foil.

Advantageously, the heat-conducting element comprises aluminium foil.

The heat-conducting element may be a susceptor. In such embodiments, the aerosol-generating article may be configured for use with an electrically-operated aerosol-generating device comprising an inductor for producing a fluctuating or alternating electromagnetic field.

In such embodiments, the aerosol-generating article engages with the aerosol-generating device such that, in use, the fluctuating or alternating electromagnetic field produced by the inductor induces eddy currents in the susceptor, causing the susceptor to heat up as a result of one or both of resistive losses (Joule heating) and, where the susceptor is magnetic, hysteresis losses. Heat generated in the susceptor is transferred to the aerosol-forming substrate by conduction.

According to the invention there is also provided an aerosol-generating system comprising: an aerosol-generating article according to the invention further comprising a heat-conducting element radially inward of the outermost wrapper, wherein the heat-conducting element is a susceptor; and an electrically-operated aerosol-generating device comprising an inductor for producing a fluctuating or alternating electromagnetic field.

As described further below, in other embodiments, the aerosol-generating article may comprise a combustible heat source. In such embodiments, the heat-conducting element transfers heat from the combustible heat source to the aerosol-forming substrate by conduction.

Advantageously, the outermost wrapper is around at least a portion of the heat-conducting element. That is, the outermost wrapper overlies at least a portion of the heat-conducting element. In such embodiments, the heat-conducting element is radially separated from the metal layer of the metallised substrate of the outermost wrapper by the substrate layer of the metallised substrate of the outermost wrapper.

The aerosol-generating article may further comprise one or more additional wrappers between the heat-conducting element and the outermost wrapper. In such embodiments, the heat-conducting element is radially separated from the metal layer of the metallised substrate of the outermost wrapper by the one or more additional wrappers and the substrate layer of the metallised substrate.

The outermost wrapper may extend longitudinally to substantially the same position along the length of the aerosol-generating article as the heat-conducting element in an upstream direction. In such embodiments, the upstream ends of the outermost wrapper and the heat-conducting element are substantially aligned.

The outermost wrapper may extend longitudinally to substantially the same position along the length of the aerosol-generating article as the heat-conducting element in a downstream direction. In such embodiments, the downstream ends of the outermost wrapper and the heat-conducting element are substantially aligned.

The outermost wrapper may extend longitudinally to substantially the same position along the length of the aerosol-generating article as the heat-conducting element in both an upstream direction and a downstream direction. In such embodiments, the upstream ends of the outermost wrapper and the heat-conducting element are substantially aligned and the downstream ends of the outermost wrapper and the heat-conducting element are substantially aligned and the outermost wrapper directly overlies the heat-conducting element.

The outermost wrapper may extend longitudinally beyond the first heat-conducting element in one or both of the upstream direction and the downstream direction.

The heat-conducting element may extend longitudinally beyond the outermost wrapper in one or both of the upstream and downstream direction.

The metallised substrate of the outermost wrapper may advantageously reduce heat losses from the heat-conducting element.

By reducing heat losses from the heat-conducting element, the metallised substrate of the outermost wrapper may advantageously help to better maintain the temperature of the heat-conducting element within a desired temperature range.

The aerosol-generating article may further comprise a heat source.

The heat source may be, for example, a heat sink, a chemical heat source, an electrical heat source or a combustible heat source.

According to one preferred aspect of the invention there is provided an aerosol-generating article comprising: a combustible heat source; an aerosol-forming substrate; and an outermost wrapper around at least a portion of the aerosol-forming substrate, wherein an outer surface of the outermost wrapper forms at least part of an outer surface of the aerosol-generating article and wherein the outermost wrapper comprises a metallised substrate comprising a substrate layer and a metal layer radially outward of the substrate layer, the metal layer having a thickness of less than or equal to about 100 nanometres.

Preferably, the combustible heat source is a solid combustible heat source.

More preferably, the combustible heat source is a monolithic solid combustible heat source. That is, a one-piece solid combustible heat source.

Advantageously, the combustible heat source is substantially cylindrical.

The combustible heat source may have a length of between about 7 millimetres and about 17 millimetres, for example a length of between about 7 millimetres and about 15 millimetres or a length of between about 7 millimetres and about 13 millimetres.

The combustible heat source may have a diameter of between about 5 millimetres and about 9 millimetres, for example a diameter of between about 7 millimetres and about 8 millimetres.

Advantageously, the combustible heat source is a combustible carbonaceous heat source.

As used herein with reference to the invention, the term 'carbonaceous' is used to describe a combustible heat source comprising carbon.

Advantageously, the combustible heat source comprises carbonised material.

Advantageously, the combustible carbonaceous heat source has a carbon content of at least about 35 percent by dry weight of the combustible carbonaceous heat source.

The combustible carbonaceous heat source may have a carbon content of at least about 40 percent by dry weight of the combustible carbonaceous heat source or a carbon content of at least about 45 percent by dry weight of the combustible carbonaceous heat source.

The combustible carbonaceous heat source may be a combustible carbon-based heat source.

As used herein with reference to the invention, the term 'carbon-based' is used to describe a combustible carbonaceous heat source comprised primarily of carbon, that is a combustible carbonaceous heat source having a carbon content of at least about 50 percent by dry weight of the combustible carbonaceous heat source. For example, the combustible carbonaceous heat source may have a carbon content of at least about 60 percent by dry weight of the combustible carbonaceous heat source or at least about 70 percent by dry weight of the combustible carbonaceous heat source or at least about 80 percent by dry weight of the combustible carbonaceous heat source.

The combustible carbonaceous heat source may be formed from one or more suitable carbon-containing materials.

One or more binders may be combined with the one or more carbon-containing materials. In such embodiments, the combustible carbonaceous heat source may comprise one or more organic binders, one or more inorganic binders or a combination of one or more organic binders and one or more inorganic binders.

The combustible carbonaceous heat source may comprise one or more additives in order to improve the properties of the combustible carbonaceous heat source. Suitable additives include, but are not limited to: additives to promote consolidation of the combustible carbonaceous heat source (for example, sintering aids); additives to promote ignition of the combustible carbonaceous heat source (for example, oxidisers such as perchlorates, chlorates, nitrates, peroxides, permanganates, zirconium and combinations thereof); additives to promote combustion of the combustible carbonaceous heat source (for example, potassium and potassium salts, such as potassium citrate); additives to promote decomposition of one or more gases produced by combustion of the combustible carbonaceous heat source (for example catalysts, such as CuO, $Fe_2O_3$ and $Al_2O_3$); or any combination thereof.

Advantageously, the combustible carbonaceous heat source comprises at least one ignition aid. In certain preferred embodiments, the combustible carbonaceous heat source comprises at least one ignition aid as described in WO 2012/164077 A1.

Suitable processes for producing combustible carbonaceous heat sources for use in aerosol-generating articles according to the invention are known in the art and include, but are not limited to, pressing processes and an extrusion processes.

In certain preferred embodiments, the combustible heat source is a pressed combustible carbonaceous heat source.

Advantageously, the combustible heat source is located at or proximate to the distal end of the aerosol-generating article.

Advantageously, the aerosol-forming substrate is downstream of the combustible heat source. That is, the aerosol-forming substrate is advantageously located between the combustible heat source and the proximal end of the aerosol-generating article.

The aerosol-forming substrate may abut the combustible heat source.

Alternatively, the aerosol-forming substrate may be longitudinally spaced apart from the combustible heat source.

Advantageously, the outermost wrapper is around at least a portion of the combustible heat source. That is, the outermost wrapper overlies at least a portion of the combustible heat source.

Advantageously, the aerosol-generating article further comprises a heat-conducting element radially inward of the outermost wrapper as described above.

Advantageously, the heat-conducting element is around at least a portion of the combustible heat source and at least a portion of the aerosol-forming substrate.

More advantageously, the heat-conducting element is around and in contact with at least a rear portion of the combustible heat source and at least a front portion of the aerosol-forming substrate.

In such embodiments, the heat-conducting element provides a thermal link between the combustible heat source and the aerosol-forming substrate of the aerosol-generating article. This advantageously helps to facilitate adequate heat transfer from the combustible heat source to the aerosol-forming substrate to provide an acceptable aerosol.

Advantageously, the rear portion of the heat source in contact with the heat-conducting element is between about 2 millimetres and about 8 millimetres in length, more advantageously between about 3 millimetres and about 5 millimetres in length.

The aerosol-generating article may further comprise a cap configured to at least partially cover a front portion of the combustible heat source. In such embodiments, the cap is removable to expose a front portion of the combustible heat source prior to use of the aerosol-generating article.

As used herein with reference to the invention, the term 'cap' is used to describe a protective cover at the distal end of the aerosol-generating article that substantially surrounds a front portion of the combustible heat source.

The aerosol-generating article may further comprise a non-combustible substantially air impermeable barrier between a rear end face of the combustible heat source and the aerosol-forming substrate.

Inclusion of a non-combustible substantially air impermeable barrier between a rear end face of the combustible heat source and the aerosol-forming substrate may advantageously limit the temperature to which the aerosol-forming substrate is exposed during ignition and combustion of the combustible heat source. This may help to avoid or reduce thermal degradation or combustion of the aerosol-forming substrate during use of the aerosol-generating article.

Inclusion of a non-combustible substantially air impermeable barrier between the rear end face of the combustible heat source and the aerosol-forming substrate may advantageously substantially prevent or inhibit migration of components of the aerosol-forming substrate to the combustible heat source during storage and use of the aerosol-generating article.

As used herein with reference to the invention, the term 'non-combustible' is used to describe a barrier that is substantially non-combustible at temperatures reached by the combustible heat source during ignition and combustion thereof.

The barrier may abut one or both of the rear end face of the combustible heat source and the aerosol-forming substrate. Alternatively, the barrier may be longitudinally spaced apart from one or both of the rear end face of the combustible heat source and the aerosol-forming substrate.

Advantageously, the barrier is adhered or otherwise affixed to the rear end face of the combustible heat source.

Suitable methods for adhering or affixing a barrier to the rear end face of the combustible heat source are known in the art and include, but are not limited to: spray-coating; vapour deposition; dipping; material transfer (for example, brushing or gluing); electrostatic deposition; pressing; or any combination thereof.

The barrier between the rear end face of the combustible heat source and the aerosol-forming substrate may have a low thermal conductivity or a high thermal conductivity. For example, the barrier may be formed from material having a bulk thermal conductivity of between about 0.1 W per metre Kelvin (W/(m·K)) and about 200 W per metre Kelvin (W/(m·K)), at 23° C. and a relative humidity of 50% as measured using the modified transient plane source (MTPS) method.

The thickness of the barrier between the rear end face of the combustible heat source and the aerosol-forming substrate may be selected to achieve good performance. For example, the barrier may have a thickness of between about 10 micrometres and about 500 micrometres.

The barrier between the rear end face of the combustible heat source and the aerosol-forming substrate may be formed from one or more suitable materials that are substantially thermally stable and non-combustible at temperatures achieved by the combustible heat source during ignition and combustion thereof. Suitable materials are known in the art and include, but are not limited to: clays such as, for example, bentonite and kaolinite; glasses; minerals; ceramic materials; resins; metals; or any combination thereof.

In certain preferred embodiments, the barrier comprises aluminium foil.

A barrier of aluminium foil may be applied to the rear end face of the combustible heat source by gluing or pressing it to the combustible heat source. The barrier may be cut or otherwise machined so that the aluminium foil covers and adheres to at least substantially the entire rear end face of the combustible heat source. Advantageously, the aluminium foil covers and adheres to the entire rear end face of the combustible heat source.

The combustible heat source may be a non-blind combustible heat source.

As used herein with reference to the invention, the term 'non-blind' is used to describe a combustible heat source including at least one airflow channel extending along the length of the combustible heat source.

As used herein with reference to the invention, the term 'airflow channel' is used to describe a channel extending along the length of a combustible heat source through which air may be drawn for inhalation by a user.

Where the combustible heat source is a non-blind combustible heat source, heating of the aerosol-forming substrate occurs by conduction and forced convection.

Where the aerosol-generating article according to the invention comprise a non-blind combustible heat source and a non-combustible, substantially air impermeable barrier between a rear end face of the combustible heat source and the aerosol-forming substrate, the barrier should allow air drawn through at least one airflow channel extending along the length of the combustible heat source to be drawn downstream through the aerosol-generating article.

Where the combustible heat source is a non-blind combustible heat source, the aerosol-generating article may further comprise a non-combustible substantially air impermeable barrier between the non-blind combustible heat source and the at least one airflow channel.

Inclusion of a non-combustible substantially air impermeable barrier between the non-blind combustible heat source and the at least one airflow channel may advantageously substantially prevent or inhibit combustion and decomposition products formed during ignition and combustion of the non-blind combustible heat source from entering air drawn through at least one airflow channel.

Inclusion of a non-combustible substantially air impermeable barrier between the non-blind combustible heat source and the at least one airflow channel may advantageously substantially prevent or inhibit activation of combustion of the non-blind combustible heat source during puffing by a user. This may substantially prevent or inhibit spikes in the temperature of the aerosol-forming substrate during puffing by a user.

The barrier between the non-blind combustible heat source and the at least one airflow channel may have a low thermal conductivity or a high thermal conductivity.

The thickness of the barrier between the non-blind combustible heat source and the at least one airflow channel may be selected to achieve good performance.

The barrier between the non-blind combustible heat source and the at least one airflow channel may be formed from one or more suitable materials that are substantially thermally stable and non-combustible at temperatures achieved by the non-blind combustible heat source during ignition and combustion thereof. Suitable materials are known in the art and include, but are not limited to: clays; metal oxides, such as iron oxide, alumina, titania, silica, silica-alumina, zirconia and ceria; zeolites; zirconium phosphate and other ceramic materials; or any combination thereof.

The barrier between the non-blind combustible heat source and the at least one airflow channel may comprise a liner inserted into the at least one airflow channel.

The barrier between the non-blind combustible heat source and the at least one airflow channel may be adhered or otherwise affixed to the inner surface of the at least one airflow channel of the non-blind combustible heat source.

Suitable methods for adhering or affixing a barrier to the inner surface of the at least one airflow channel of the non-blind combustible heat source are known in the art and include, but are not limited to, the methods described in U.S. Pat. No. 5,040,551 and WO 2009/074870 A2.

Advantageously, the combustible heat source is a blind combustible heat source.

As used herein with reference to the invention, the term 'blind' is used to describe a combustible heat source that does not include any airflow channels extending along the length of the combustible heat source through which air may be drawn for inhalation by a user.

As used herein with reference to the invention, the term 'blind' is also used to describe a combustible heat source including one or more airflow channels extending along the length of the combustible heat source, wherein a non-combustible substantially air impermeable barrier between a rear end face of the combustible heat source and the aerosol-forming substrate barrier prevents air from being drawn through the one or more airflow channels for inhalation by a user.

Where the combustible heat source is a blind combustible heat source, in use air drawn through the aerosol-generating article does not pass through any airflow channels along the length of the blind combustible heat source.

Where the combustible heat source is a blind combustible heat source, heating of the aerosol-forming substrate occurs primarily by conduction and heating of the aerosol-forming substrate by forced convection is minimised or reduced. In such embodiments, it is particularly important to optimise the conductive heat transfer between the combustible heat source and the aerosol-forming substrate.

Providing an outermost wrapper around at least a portion of the aerosol-substrate wherein the outermost wrapper comprises a metallised substrate comprising a substrate layer and a metal layer radially outward of the substrate layer, the metal layer having a thickness of less than or equal to about 100 nanometres, has been found to have a particularly advantageous effect on the performance of the aerosol-generating article where the combustible heat source is a blind combustible heat sources and there is little if any compensatory heating effect due to convection.

The lack of any airflow channels extending along the length of the combustible heat source through which air may be drawn for inhalation by a user advantageously substantially prevents or inhibits activation of combustion of the blind combustible heat source during puffing by a user. This substantially prevents or inhibits spikes in the temperature of the aerosol-forming substrate during puffing by a user.

By preventing or inhibiting activation of combustion of the blind combustible heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimised or reduced.

Inclusion of a blind combustible heat source may also advantageously substantially prevent or inhibit combustion and decomposition products and other materials formed during ignition and combustion of the blind combustible heat source from entering air drawn through the aerosol-generating article for inhalation by a user.

Where the combustible heat source is a blind combustible heat source and the aerosol-forming substrate is downstream of the combustible heat source, the aerosol-generating article further comprise one or more air inlets downstream of the blind combustible heat source for drawing air into the aerosol-generating article for inhalation by a user.

In such embodiments, air drawn through the aerosol-generating article for inhalation by a user enters the aerosol-generating article through the one or more air inlets and not through the distal end of the aerosol-generating article.

Where the combustible heat source is a non-blind combustible heat source and the aerosol-forming substrate is downstream of the combustible heat source, the aerosol-generating article may also further comprise one or more air inlets downstream of the non-blind combustible heat source for drawing air into the aerosol-generating article for inhalation by a user.

Advantageously, the aerosol-generating article may further comprise one or more air inlets around the periphery of the aerosol-forming substrate.

In such embodiments, during puffing by a user cool air is drawn into the aerosol-forming substrate of the aerosol-generating article through the one or more air inlets around the periphery of the aerosol-forming substrate. This advantageously reduces the temperature of the aerosol-forming substrate and so substantially prevents or inhibits spikes in the temperature of the aerosol-forming substrate during puffing by a user.

As used herein with reference to the invention, the term 'cool air' is used to describe ambient air that is not significantly heated by the combustible heat source upon puffing by a user.

By preventing or inhibiting spikes in the temperature of the aerosol-forming substrate, the inclusion of one or more air inlets around the periphery of the aerosol-forming substrate, advantageously helps to avoid or reduce combustion or pyrolysis of the aerosol-forming substrate under intense puffing regimes. In addition, inclusion of one or more air inlets around the periphery of the aerosol-forming substrate advantageously helps to minimise or reduce the impact of a user's puffing regime on the composition of the mainstream aerosol of the aerosol-generating article.

In certain preferred embodiments, the aerosol-generating article comprises one or more air inlets located proximate to a downstream end of the aerosol-forming substrate.

Where the combustible heat source is a non-blind combustible heat source or a blind combustible heat source, the combustible heat source may comprise one or more closed or blocked passageways through which air may not be drawn for inhalation by a user.

For example, the combustible heat source may comprise one or more closed passageways that extend only part way along the length of the combustible heat source.

The inclusion of one or more closed air passageways increases the surface area of the combustible heat source that is exposed to oxygen from the air and may advantageously facilitate ignition and sustained combustion of the combustible heat source.

The aerosol-generating article may comprise a retractable combustible heat source.

In such embodiments, the combustible heat source may be slideable from an extended position to a retracted position wherein the length of the aerosol-generating article with the combustible heat source in the retracted position is less than the length of the aerosol-generating article with the combustible heat source in the extended position.

The combustible heat source may at least partially retract into a tubular body of the aerosol-generating article. The tubular body may advantageously modulate the amount of airflow to the combustible heat source on demand. The tubular body may thereby facilitate extinguishment of the combustible heat source on demand.

Advantageously, the combustible heat source may entirely retract into the tubular body of the aerosol-generating article in the retracted position.

The tubular body may comprise a heat reactive material. The heat reactive material may advantageously seal and secure the combustible heat source in the retracted position.

The tubular body may comprise a heat-insulative material. The heat-insulative material may advantageously retain heat within the aerosol generating article until the combustible heat source has cooled. This may advantageously reduce potential risk associated with improper handling of the aerosol-generating article after use.

The tubular body may comprise a retention element that maintains the combustible heat source in the extended position until sufficient force overcomes the retention element and retracts the combustible heat source into the tubular body to the retracted position.

Provision of such a retention element may advantageously prevent the combustible heat source from retracting accidentally by requiring positive action or force from the user to move the combustible heat source from the extended position to the extracted position.

The tubular body may hold the aerosol-forming substrate. In such embodiments, an outer surface of the outermost wrapper may form an outer surface of the tubular body that forms at least part of an outer surface of the aerosol-generating article in at least the extended position.

The aerosol generating article may further comprise an inner tubular member holding the combustible heat source, wherein the inner tubular member is at least partially disposed within a distal end of the tubular body and is slideable from the extended position to the retracted position.

The inner tubular member may hold the aerosol-forming substrate. In such embodiments, an outer surface of the outermost wrapper may form an outer surface of the inner tubular element that forms at least part of an outer surface of the aerosol-generating article in at least the extended position.

Aerosol-generating articles according to the invention may further comprise a transfer element or spacer element downstream of the aerosol-forming substrate. That is, a transfer element or spacer element located between the aerosol-forming substrate and the proximal end of the aerosol-generating article.

The transfer element may abut the aerosol-forming substrate. Alternatively, the transfer element may be longitudinally spaced apart from the aerosol-forming substrate.

The inclusion of a transfer element advantageously allows cooling of the aerosol generated by heat transfer to the aerosol-forming substrate. The inclusion of a transfer element also advantageously allows the overall length of aerosol-generating articles according to the invention to be adjusted to a desired value, for example to a length similar to that of a conventional cigarette, through an appropriate choice of the length of the transfer element.

The transfer element may have a length of between about 7 millimetres and about 50 millimetres, for example a length of between about 10 millimetres and about 45 millimetres or a length of between about 15 millimetres and about 30 millimetres. The transfer element may have other lengths depending upon the desired overall length of the aerosol-generating article, and the presence and length of other components within the aerosol-generating article.

The transfer element may comprise at least one open-ended tubular hollow body. In such embodiments, in use, air drawn into the aerosol-generating article passes through the at least one open-ended tubular hollow body as it passes downstream through the aerosol-generating article from the aerosol-forming substrate to the proximal end of the aerosol-generating article.

The transfer element may comprise at least one open-ended tubular hollow body formed from one or more suitable materials that are substantially thermally stable at the temperature of the aerosol generated by the transfer of heat to the aerosol-forming substrate. Suitable materials are known in the art and include, but are not limited to, paper, cardboard, plastics, such a cellulose acetate, ceramics and combinations thereof.

Aerosol-generating articles according to the invention may further comprise an aerosol-cooling element or heat exchanger downstream of the aerosol-forming substrate. That is, an aerosol-cooling element or heat exchanger located between the aerosol-forming substrate and the proximal end of the aerosol-generating article.

The aerosol-cooling element may comprise a plurality of longitudinally extending channels.

The aerosol-cooling element may comprise a gathered sheet of material selected from the group consisting of metallic foil, polymeric material, and substantially non-porous paper or cardboard. In certain embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

The aerosol-cooling element may comprise a gathered sheet of biodegradable polymeric material, such as polylactic acid (PLA) or a grade of Mater-Bi® (a commercially available family of starch based copolyesters).

Where aerosol-generating articles according to the invention further comprise a transfer element downstream of the aerosol-forming substrate and an aerosol-cooling element downstream of the aerosol-forming substrate, the aerosol-cooling element is preferably downstream of the transfer element. That is, the aerosol-cooling element is preferably located between the transfer element and the proximal end of the aerosol-generating article.

Aerosol-generating articles according to the invention may further comprise a mouthpiece downstream of the aerosol-forming substrate. That is, a mouthpiece located between the aerosol-forming substrate and the proximal end of the aerosol-generating article.

Preferably, the mouthpiece is located at the proximal end of the aerosol-generating article.

Preferably, the mouthpiece is of low filtration efficiency, more preferably of very low filtration efficiency.

The mouthpiece may be a single segment or component mouthpiece.

Alternatively, the mouthpiece may be a multi-segment or multi-component mouthpiece.

The mouthpiece may comprise a filter comprising one or more segments comprising suitable filtration materials. Suitable filtration materials are known in the art and include, but are not limited to, cellulose acetate and paper. Alternatively or in addition, the mouthpiece may comprise one or more segments comprising absorbents, adsorbents, flavourants, and other aerosol modifiers and additives or combinations thereof.

Aerosol-generating articles according to the invention may comprise one or more aerosol modifying agents downstream of the aerosol-forming substrate. For example, where included, one or more of the mouthpiece, transfer element and aerosol-cooling element of aerosol-generating articles according to the invention may comprise one or more aerosol modifying agents.

As used herein with reference to the invention, the term 'aerosol-modifying agent' is used to describe any agent that, in use, modifies one or more features or properties of an aerosol generated by the aerosol-forming substrate of the aerosol-generating article.

Suitable aerosol-modifying agents include, but are not limited to: flavourants; and chemesthetic agents.

As used herein with reference to the invention, the term 'chemesthetic agent' is used to describe any agent that, in use, is perceived in the oral or olfactory cavities of a user by means other than, or in addition to, perception via taste receptor or olfactory receptor cells. Perception of chemesthetic agents is typically via a "trigeminal response," either via the trigeminal nerve, glossopharyngeal nerve, the vagus nerve, or some combination of these. Typically, chemesthetic agents are perceived as hot, spicy, cooling, or soothing sensations.

Aerosol-generating articles according to the invention may comprise one or more aerosol modifying agents that are both a flavourant and a chemesthetic agent downstream of the aerosol-forming substrate. For example, where included, one or more of the mouthpiece, transfer element and aerosol-cooling element of aerosol-generating articles according to the invention may comprise menthol or another flavourant that provides a cooling chemesthetic effect.

Where aerosol-generating articles according to the invention further comprise one or more components downstream of the aerosol-forming substrate such as, for example, a transfer element, a cooling element or a mouthpiece, the outermost wrapper may be around some or all of the components downstream of the aerosol-forming substrate.

In such embodiments, the aerosol-generating article may further comprise one or more additional wrappers around some or all of the components downstream of the aerosol-forming substrate that are radially outward of the outermost wrapper.

Aerosol-generating articles according to the invention may be assembled using known methods and machinery.

For the avoidance of doubt, features described above in relation to one aspect of the invention may also be applied to other aspects of the invention.

The aerosol-generating article 2 according to the embodiment of the invention shown in FIG. 1 comprises a combustible carbonaceous heat source 4 having a front end face 6 and an opposed rear end face 8, an aerosol-forming substrate 10, a transfer element 12, an aerosol-cooling element 14, a space 16 and a mouthpiece 18 in abutting coaxial alignment. The aerosol-forming substrate 10, transfer element 12 and aerosol-cooling element 14 and a rear portion of the combustible carbonaceous heat source 4 are wrapped in an outermost wrapper 20. As shown in FIG. 1, a downstream end portion of the outermost wrapper 20 around a rear portion of the aerosol-cooling element 14, the space 16 and the mouthpiece 18 are wrapped in a band of tipping paper 22, which connects the mouthpiece 18 to the other components of the aerosol-generating article 2.

The combustible carbonaceous heat source 4 is a blind carbonaceous combustible heat source and is located at the distal end of the aerosol-generating article 2. As shown in FIG. 1, a non-combustible substantially air impermeable barrier 24 in the form of a disc of aluminium foil is provided between the rear end face 8 of the combustible carbonaceous heat source 4 and the aerosol-forming substrate 10. The barrier 24 is applied to the rear end face 8 of the combustible carbonaceous heat source 4 by pressing the disc of aluminium foil onto the rear end face 8 of the combustible carbonaceous heat source 4 and abuts the rear end face 8 of the combustible carbonaceous heat source 4 and the a front end of the aerosol-forming substrate 10.

The aerosol-forming substrate 10 is located immediately downstream of the barrier 24 applied to the rear end face 8 of the combustible carbonaceous heat source 4. The aerosol-forming substrate 10 comprises a gathered crimped sheet of homogenised tobacco material 26 and a wrapper 28 around and in contact with the gathered crimped sheet of homogenised tobacco material 26. The gathered crimped sheet of homogenised tobacco material 26 comprises a suitable aerosol former such as, for example, glycerine.

The transfer element 12 is located immediately downstream of the aerosol-forming substrate 10 and comprises a cylindrical open-ended hollow cellulose acetate tube 30.

The aerosol-cooling element 14 is located immediately downstream of the transfer element 12 and comprises a gathered sheet of biodegradable polymeric material such as, for example, polylactic acid.

The mouthpiece 18 is located downstream of the aerosol-cooling element 14. As shown in FIG. 1, the mouthpiece 18 is located at the proximal end of the aerosol-generating article 2 and comprises a cylindrical plug of suitable filtration material 32 such as, for example, cellulose acetate tow of very low filtration efficiency, wrapped in filter plug wrap 34.

In the aerosol-generating article 2 according to the embodiment of the invention shown in FIG. 1, the aerosol-generating article 2 comprises a space 16 between the aerosol-cooling element 14 and the mouthpiece 18.

In other embodiments of the invention (not shown) the space 16 between the aerosol-cooling element 14 and the mouthpiece 18 may be omitted and the mouthpiece 18 may be located immediately downstream of the aerosol-cooling element 14.

In further embodiments of the invention (also not shown) both the aerosol-cooling element and the space 16 between the aerosol-cooling element 14 and the mouthpiece 18 may both be omitted and the mouthpiece 18 may be located immediately downstream of the transfer element 12.

The outermost wrapper 20 comprises a metallised substrate comprising a substrate layer and a metal layer radially outward of the substrate layer, the metal layer having a thickness of less than or equal to about 100 nanometres. The outermost wrapper 20 may further comprise a surface coating on at least a portion of an outer surface of the metal layer of the metallised substrate.

As shown in FIG. 1, the aerosol-generating article 2 further comprises a heat-conducting element 36 formed from a suitable thermally conductive material such as, for example, aluminium foil around and in direct contact with a rear portion 4*b* of the combustible carbonaceous heat source 4 and a front portion 10*a* of the aerosol-forming substrate 10. In the aerosol-generating article 2 according to the embodiment of the invention shown in FIG. 1, the aerosol-forming substrate 10 extends downstream beyond the heat-conducting element 36.

The aerosol-generating article 2 according to the embodiment of the invention shown in FIG. 1 comprises one or more air inlets 38 around the periphery of a rear portion of the aerosol-forming substrate 10. As shown in FIG. 1, a circumferential arrangement of air inlets 38 is provided in the wrapper 28 of the aerosol-forming substrate 10 and the overlying outermost wrapper 20 to admit cool air (shown by dotted arrows in FIG. 1) into the aerosol-forming substrate 10.

In use, a user ignites the combustible carbonaceous heat source 4. Once the combustible carbonaceous heat source 4 is ignited the user draws on the mouthpiece 18 of the aerosol-generating article 2. When a user draws on the mouthpiece 18, cool air (shown by dotted arrows in FIG. 1) is drawn into the aerosol-forming substrate 10 of the aerosol-generating article 2 through the air inlets 38.

The periphery of the front portion 10*a* of the aerosol-forming substrate 10 is heated by conduction through the rear end face 8 of the combustible carbonaceous heat source 4 and the barrier 24 and through the heat-conducting element 36.

The heating of the aerosol-forming substrate 10 by conduction releases aerosol former and other volatile and semi-volatile compounds from the gathered crimped sheet of homogenised tobacco material 26. The compounds released from the aerosol-forming substrate 10 form an aerosol that is entrained in the air drawn into the aerosol-forming substrate 10 of the aerosol-generating article 2 through the air inlets 38 as it flows through the aerosol-forming substrate 10. The drawn air and entrained aerosol (shown by dashed arrows in FIG. 1) pass downstream through the interior of the cylindrical open-ended hollow cellulose acetate tube 38 of the transfer element 12 and the aerosol-cooling element 14, where they cool and condense. The cooled drawn air and entrained aerosol pass downstream through the space 16 and the mouthpiece 18 and are delivered to the user through the proximal end of the aerosol-generating article 2. The non-combustible substantially air impermeable barrier 24 on the rear end face 8 of the combustible carbonaceous heat source 4 isolates the combustible carbonaceous heat source 4 from air drawn through the aerosol-generating article 2 such that, in use, air drawn through the aerosol-generating article 2 does not come into direct contact with the combustible carbonaceous heat source 4.

An example of an aerosol-generating article 2 according to the embodiment of the invention shown in FIG. 1 is produced comprising an aerosol-forming substrate 10 comprising a gathered crimped sheet of homogenised tobacco material 26 comprising glycerine, a heat-conducting element 36 formed of aluminium foil, an aerosol-cooling element 14 comprising a gathered crimped sheet of polylactic acid and a mouthpiece 18 comprising a plug of cellulose acetate tow. The outermost wrapper 20 of the aerosol-generating article 2 comprises a metallised substrate comprising a paper layer and an aluminium layer radially outward of the paper layer. The paper layer of the metallised substrate has a basis weight of 50 grams per square metre and a thickness of about 50 micrometres. The aluminium layer of the metallised substrate has a weight of between about 0.04 grams per square metre and about 0.1 grams per square metre and a thickness of between about 15 nanometres and about 35 nanometres. The outermost wrapper 20 further comprises a continuous surface coating on the entire outer surface of the aluminium layer of the metallised substrate. The surface coating is a lacquer comprising 60 percent by weight of calcium carbonate. The surface coating has a weight of about 2.7 grams per square metre and a thickness of about 1 micrometre.

A comparative example of an aerosol-generating article not according to the invention is also produced. The comparative example of the aerosol-generating article not according to the invention is of largely similar construction to the example of the aerosol-generating article 2 according to the embodiment of the invention shown in FIG. 1. However, the outermost wrapper of the comparative example of the aerosol-generating article not according to the invention comprises a laminate comprising a paper layer and a metal layer radially outward of the paper layer. The paper layer of the laminate has a basis weight of 45 grams per square metre and a thickness of about 70 micrometres. The aluminium layer of the laminate has a weight of about 17 grams per square metre and a thickness of about 6.3 micrometres. The outermost wrapper further comprises a continuous surface coating on the entire outer surface of the aluminium layer of the laminate. The surface coating is a lacquer comprising 60 percent by weight of calcium carbonate. The surface coating has a weight of about 2.7 grams per square metre and a thickness of about 1 micrometre.

As shown In Table 1, the length of the front portion 10*a* of the aerosol-forming substrate 10 in contact with the heat conducting element 36 in the example of the aerosol-generating article 2 according to the embodiment of the invention shown in FIG. 1 is greater than the length of the front portion of the aerosol-forming substrate in contact with heat conducting element in the comparative example of the aerosol-generating article not according to the invention.

The construction and dimensions of the comparative example of the aerosol-generating article not according to the invention are otherwise the same as the construction and dimensions of the example of the aerosol-generating article according to the embodiment of the invention shown in FIG. 1.

TABLE 1

| | Example | Comparative example |
|---|---|---|
| Length of heat conducting element | 8 mm | 5 mm |
| Length of rear portion of combustible carbonaceous heat source in contact with heat conducting element | 3 mm | 3 mm |
| Length of front portion of aerosol-forming substrate in contact with heat conducting element | 5 mm | 2 mm |

Figure 2:
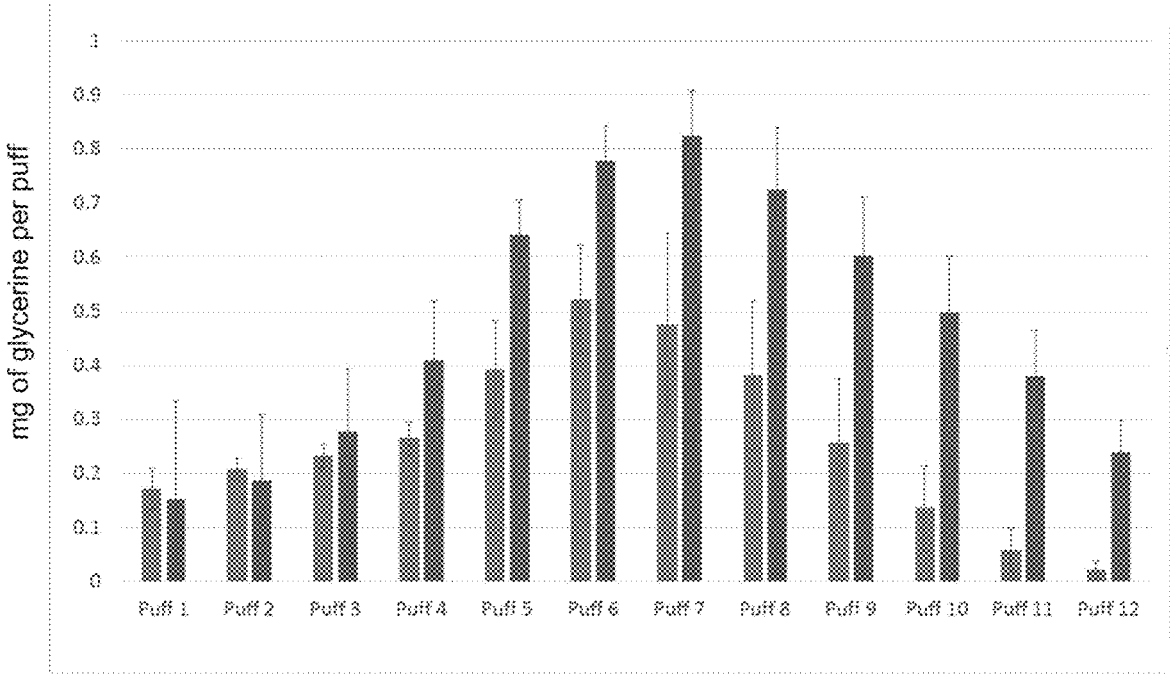
FIG. 2 shows a graph of the amounts of aerosol former (glycerine) per puff for an example of the aerosol-generating article according to the embodiment shown in FIG. 1 and a comparative example of an aerosol-generating article not according to the invention.

The amount of glycerine (in micrograms) per puff for the example of the aerosol-generating article 2 according to the invention shown in FIG. 1 and the comparative example of the aerosol-generating article not according to the invention is measured as a function of puff number under a Health Canada smoking regime over 12 puffs with a puff volume of 55 ml, puff duration of 2 seconds and a puff interval of 30 seconds. The results are shown in FIG. 2. In FIG. 2, the right hand columns show the puff-by-puff delivery profile for the example of the aerosol-generating article 2 according to the invention shown in FIG. 1 and the left-hand columns show the puff-by-puff delivery profile for the comparative example of the aerosol-generating article not according to the invention.

As shown in FIG. 2, inclusion in the aerosol-generating article according to the invention of an outermost wrapper comprising a metallised substrate comprising a substrate layer and a metal layer radially outward of the substrate layer, wherein the metal layer has a thickness of less than or equal to about 100 nanometres advantageously results in a significant increase in the amount of glycerine in puffs 4 to 12 compared to the aerosol-generating article not according to the invention, which comprises an outermost wrapper comprising a laminate comprising a substrate layer and a metal layer radially outward of the substrate layer, wherein the metal layer has a thickness of greater than 100 nanometres.

In fact the outermost wrapper of the aerosol-generating article according to the invention is so effective in reducing radiative and conductive heat losses compared to the outermost wrapper of the aerosol-generating article not according to the invention that it is necessary to increase the length of the front portion of the aerosol-forming substrate in contact with the heat conducting element in the aerosol-generating article according to the invention compared to the aerosol-generating article not according to the invention in order to prevent burning of the paper layer of the metallised substrate of the outermost wrapper of the aerosol-generating article according to the invention.

The specific embodiment and example described above illustrate but do not limit the invention. It is to be understood that other embodiments of the invention may be made and the specific embodiment and example described herein are not exhaustive.

The invention claimed is:

1. An aerosol-generating article, comprising:

an aerosol-forming substrate configured to be heated to generate an aerosol, wherein the aerosol-generating article does not comprise an aerosol-forming substrate that is configured to be combusted to produce smoke; and an outermost wrapper around at least a portion of the aerosol-forming substrate, wherein an outer surface of the outermost wrapper forms at least part of an outer surface of the aerosol-generating article, wherein the outermost wrapper comprises a metallized substrate comprising a substrate layer and a metal layer radially outward of the substrate layer, and wherein the substrate layer is coated with the metal layer by vapour deposition.

2. The aerosol-generating article according to claim 1, wherein the metal layer of the metallized substrate has a thickness of greater than or equal to 5 nm.

3. The aerosol-generating article according to claim 1, wherein the metal layer of the metallized substrate has a thickness of between 10 nm and 60 nm.

4. The aerosol-generating article according to claim 1, wherein the metal layer of the metallized substrate is an aluminum layer.

5. The aerosol-generating article according to claim 1, wherein the substrate layer of the metallized substrate has a thickness of between 40 μm and 80 μm.

6. The aerosol-generating article according to claim 1, wherein the substrate layer of the metallized substrate is a paper layer.

7. The aerosol-generating article according to claim 6, wherein the paper layer of the metallized substrate has a basis weight of between 35 grams per square meter and 60 grams per square meter.

8. The aerosol-generating article according to claim 1, wherein the outermost wrapper further comprises a surface coating on at least a portion of an outer surface of the metal layer of the metallized substrate.

9. The aerosol-generating article according to claim 8, wherein the surface coating comprises one or more inorganic materials selected from the group consisting of graphite, metal oxides, and metal carbonates.

10. The aerosol-generating article according to claim 1, wherein the outer surface of the outermost wrapper has an emissivity of less than or equal to 0.6.

11. The aerosol-generating article according to claim 1, wherein the outer surface of the outermost wrapper has an emissivity of greater than or equal to 0.1.

12. The aerosol-generating article according to claim 1, further comprising a heat-conducting element radially inward of the outermost wrapper.

13. The aerosol-generating article according to claim 12, wherein the outermost wrapper is around at least a portion of the heat-conducting element.

14. The aerosol-generating article according to claim 1, further comprising a heat source.

15. The aerosol-generating article according to claim 14, wherein the heat source is a combustible heat source.

16. The aerosol-generating article according to claim 15, wherein the aerosol-forming substrate is downstream of the combustible heat source.

17. The aerosol-generating article according to claim 14, wherein the outermost wrapper is around at least a portion of the heat source.

* * * * *